US005505508A

United States Patent [19]

Kuo

[11] Patent Number: 5,505,508

[45] Date of Patent: Apr. 9, 1996

[54] DOOR LOCK ASSEMBLY

[75] Inventor: Ching-Chuan Kuo, Hsien, Taiwan

[73] Assignee: Tong-Lung Metal Industry Co., Ltd., Taiwan

[21] Appl. No.: 346,516

[22] Filed: Nov. 29, 1994

[51] Int. Cl.[6] ..... E05B 13/00

[52] U.S. Cl. ..... 292/359; 292/169.17; 70/468; 70/471

[58] Field of Search ..... 292/358, 359, 292/169.17, 169.21, 169.22; 70/468, 469, 471, 481, 482

[56] References Cited

U.S. PATENT DOCUMENTS

| | | | |
|---|---|---|---|
| 2,400,403 | 5/1946 | Falk | 292/359 |
| 2,407,775 | 9/1946 | Frost | 292/169.17 X |
| 2,470,770 | 5/1949 | Harvey | 292/169.17 |
| 2,503,192 | 4/1950 | Cerf, Jr. | 292/169.17 X |
| 4,142,748 | 3/1979 | Hook | 292/169 |

FOREIGN PATENT DOCUMENTS

| | | | |
|---|---|---|---|
| 10893 | 3/1969 | Australia | 292/359 |
| 886906 | 1/1962 | United Kingdom | 292/359 |

*Primary Examiner*—Rodney M. Lindsey
*Attorney, Agent, or Firm*—Ladas & Parry

[57] ABSTRACT

A lock assembly for a door includes an inner door handle to be mounted rotatably on an inner side of the door, an outer door handle to be mounted rotatably on an outer side of the door, a latch shaft unit including coaxial first and second latch shafts, each of which having a first end connected operably to a respective one of the inner and outer door handles and a second end coupled rotatably to other one of the first and second latch shafts, a locking member to be mounted on the outer side of the door for movement between a locking position in which the locking member locks the second latch shaft against axial rotation and a freeing position in which axial rotation of the second latch shaft is permitted, and a release unit to be mounted on the inner side of the door, the release unit being associated operably with the locking member and being operable manually from the inner side of the door to move the locking member between the locking and freeing positions.

6 Claims, 5 Drawing Sheets

DOOR LOCK ASSEMBLY

BACKGROUND OF THE INVENTION

1. Field of the Invention

The invention relates to a door lock assembly, more particularly to a door lock assembly which can be locked from an inner side of a door and which, in case of an emergency, can be unlocked from an outer side of the door.

2. Description of the Related Art

Doors to some rooms, such as bedrooms and bathrooms of a house, are provided with a lock assembly which can be locked and unlocked from an inner side of the door to prevent unauthorized entry into the room. It would be desirable if, in case of an emergency, the lock assembly can be unlocked from an outer side of the door to permit rescue of a person inside the room.

SUMMARY OF THE INVENTION

The object of the present invention is to provide a door lock assembly which can be locked from an inner side of a door and which, in case of an emergency, can be unlocked from an outer side of the door.

Another object of the present invention is to provide a door lock assembly which is unlocked automatically when the lock assembly is operated from the inner side of the door.

Accordingly, the door lock assembly of the present invention comprises:

- an inner door handle to be mounted rotatably on an inner side of the door;
- an outer door handle to be mounted rotatably on an outer side of the door;
- a latch shaft unit including coaxial first and second latch shafts, each of which having a first end connected operably to a respective one of the inner and outer door handles and a second end coupled rotatably to other one of the first and second latch shafts;
- a locking member to be mounted on the outer side of the door for movement between a locking position in which the locking member locks the second latch shaft against axial rotation and a freeing position in which axial rotation of the second latch shaft is permitted;
- a release unit to be mounted on the inner side of the door, the release unit being associated operably with the locking member and being operable manually from the inner side of the door to move the locking member between the locking and freeing positions; and
- a cam plate mounted co-rotatably on the first latch shaft and actuating the release unit to move the locking member from the locking position to the freeing position when the first latch shaft is rotated by the inner door handle.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
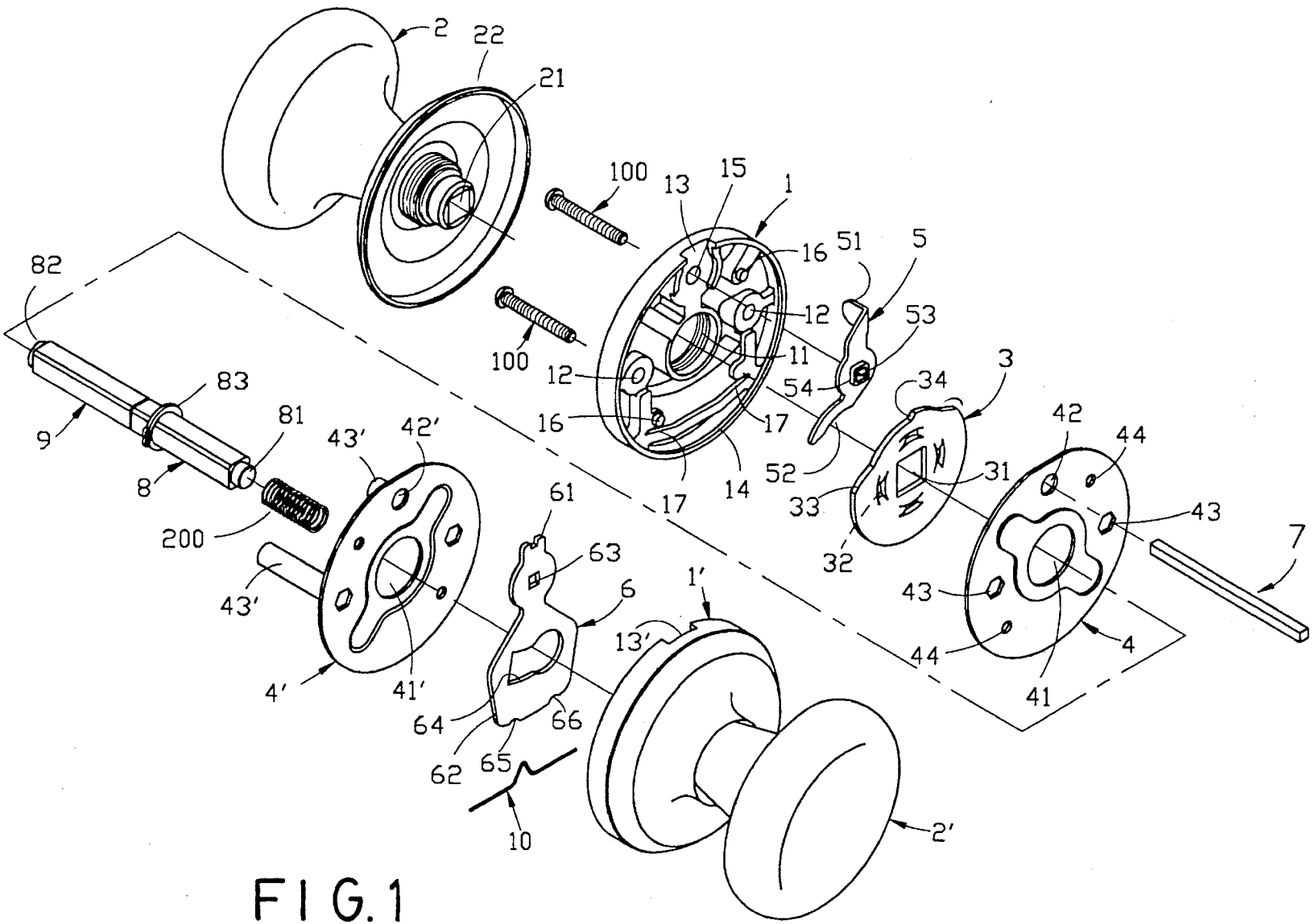
FIG. 1 is an exploded view of the preferred embodiment of a door lock assembly according to the present invention.
Figure 2:
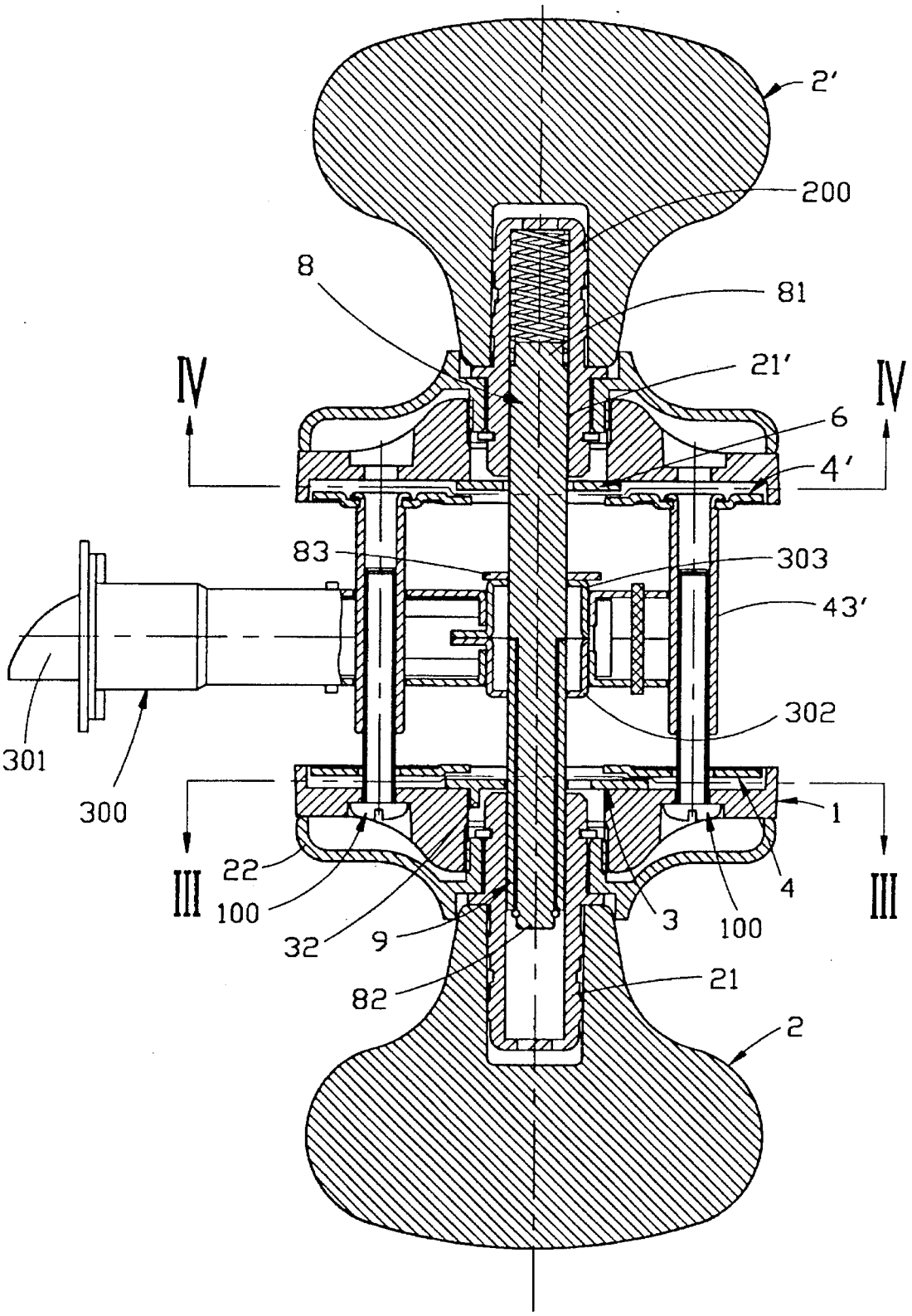
FIG. 2 is a sectional view illustrating the assembly of the preferred embodiment.

Referring to FIGS. 1 and 2, the preferred embodiment of a door lock assembly according to the present invention is shown to comprise a hollow inner mounting body including a housing 1 and a back plate 4, a hollow outer mounting body including a housing 1' and a back plate 4', an inner door handle 2, an outer door handle 2', a cam plate 3, a release unit 5, a locking member 6, a link rod 7, a latch shaft unit including coaxial first and second latch shafts 9, 8, a spring member 10 and a pair of screws 100.

The housing 1 is to be mounted on an inner side of a door and is formed with a central shaft hole 11, a pair of screw holes 12 on opposite sides of the shaft hole 11, a peripheral wall 14 with a circumferential slot 13, a pair of eccentric retaining posts 16, a pair of retaining grooves 17, and a pivot hole 15 adjacent to the slot 13.

The back plate 4 is formed with a pair of eccentric retaining holes 44 which engage the retaining posts 16 to secure the back plate 4 onto the housing 1, thereby forming the inner mounting body. The back plate 4 is further formed with a central shaft hole 41, a pivot hole 42 and a pair of screw holes 43 that are aligned with the shaft hole 11, the pivot hole 15 and the screw holes 12 of the housing 1, respectively.

The inner door handle 2 is mounted rotatably on the housing 1 in a known manner. The inner door handle 2 has a latch engaging shaft 21 which extends into the shaft hole 11 and is provided with an escutcheon plate 22 which covers the housing 1 to deny access to the screw holes 12.

The housing 1', the back plate 4' and the outer door handle 2' are similar to the housing 1, the back plate 4 and the inner door handle 2 in construction and are interconnected in a similar manner. The housing 1', the back plate 4' and the outer door handle 2' are to be mounted on an outer side of the door. The back plate 4' further has a pair of internally threaded screw posts 43' that extend toward and that are aligned with the screw holes 43 of the back plate 4. The screws 100 extend through the screw holes 12 of the housing 1, the screw holes 43 of the back plate 4 and engage the screw posts 43' on the back plate 4', thereby retaining the door lock assembly on a door (not shown). Engagement between the screws 100 and the screw posts 43' permit installation of the door lock assembly of this invention in doors of different thicknesses.

The first latch shaft 9 is formed as a hollow rectangular shaft which has one end that extends through the shaft hole 41 of the back plate 4, the shaft hole 11 of the housing 1, and which engages the latch engaging shaft 21 of the inner door handle 2. The second latch shaft 8 is formed as a solid rectangular shaft which has a first end 81 that extends through the shaft hole 41' of the back plate 4', the shaft hole of the housing 1' and which engages the latch engaging shaft 21' of the outer door handle 2'. The second latch shaft 8 has a second end 82 formed as a cylindrical shaft that extends rotatably through the first latch shaft 9. A retaining member couples rotatably the second end 82 of the second latch shaft 8 to the first latch shaft 9 and deters relative axial movement therebetween. The second latch shaft 8 further has an intermediate portion formed with a radial flange 83.

The locking member 6 is a plate-like member disposed between the housing 1' and the back plate 4' of the outer mounting body. The locking member 6 has a first end portion 61, a second end portion 62 and an intermediate portion formed with a pivot hole 63 that is aligned with the pivot hole (not shown) of the housing 1' and the pivot hole 42' of the back plate 4'. The first end portion 61 projects slightly out of the outer mounting body through the slot 13'. The second end portion 62 is formed with a through-hole 64 through which the second latch shaft 8 extends. The through-hole 64 has a shaft engaging portion conforming to the cross-section of the second latch shaft 8 and a shaft releasing portion larger than the shaft engaging portion. The first end portion 61 of the locking member 6 is operable from the outer side of the door to move along the slot 13' in order to move the locking member 6 between a locking position in which the shaft engaging portion of the through-hole 64 engages the second latch shaft 8 to lock the second latch shaft 8 against rotation (see FIG. 4) and a freeing position in which the second latch shaft 8 extends through and is unrestricted to rotate in an axial direction by the shaft releasing portion of the through-hole 64 (see FIG. 7). The second end portion 62 of the locking member 6 is further formed with first and second positioning notches 65, 66. The spring member 10 has two ends received in the retaining grooves 17' of the housing 1' (see FIG. 4) and a V-shaped portion adjacent to the locking member 6. The V-shaped portion of the spring member 10 engages releasably the first positioning notch 65 when the locking member 6 is in the locking position and the second positioning notch 66 when the locking member 6 is in the freeing position.

The release unit 5 is disposed between the housing 1 and the back plate 4 of the inner mounting body and has a lever portion 51, a camming portion 52 and a pivot portion 54 formed with a pivot hole 53 that is aligned with the pivot holes 15, 42 of the housing 1 and the back plate 4. The lever portion 51 projects out of the inner mounting body through the slot 13. The link rod 7 has a first end extending through the pivot holes 15, 53, 42 to mount pivotally the release unit 5 to the inner mounting body, and a second end extending through the pivot holes 63, 42' to mount pivotally the locking member 6 to the outer mounting body. The release unit 5 and the locking member 6 are thus mounted co-rotatably on the opposite ends of the link rod 7. When the lever portion 51 of the release unit 5 is operated along the slot 13, the link rod 7 rotates to cause corresponding rotation of the locking member 6 about the pivot hole 63 to move the locking member 6 between the locking and freeing positions.

The cam plate 3 is disposed between the housing 1 and the back plate 4 of the inner mounting body and is formed with a shaft hole 31 for mounting the same co-rotatably on the first latch shaft 9. The cam plate 3 is further formed with four sets of curved projections 32 which engage a tubular projection that confines the shaft hole 11 of the housing 1, thereby mounting rotatably the cam plate 3 on the housing 1. The cam plate 3 has a periphery formed with cam portions 33, 34 for actuating the camming portion 52 of the release unit 5 to move the locking member 6 from the locking position to the freeing position when the first latch shaft 9 is rotated by the inner door handle 2, as will described in the succeeding paragraphs.

Referring once more to FIG. 2, a spring 200 is disposed in the latch engaging shaft 81' of the outer door handle 2' and abuts the first end 81 of the second latch shaft 8. A conventional deadbolt assembly 300 includes a bolt member 301 and a pair of cam drives 302, 303 which may be operated independently to retract the bolt member 301. The cam drives 302, 303 are driven rotatably by the first and second latch shafts 9, 8, respectively. The spring 200 biases the second latch shaft 8 such that the radial flange 83 abuts tightly against the cam drive 303, thereby maintaining proper engagement between the first and second latch shafts 9, 8 and the cam drives 302, 303 to adapt the door lock assembly of this invention for use in doors of different thicknesses.

Figure 3:
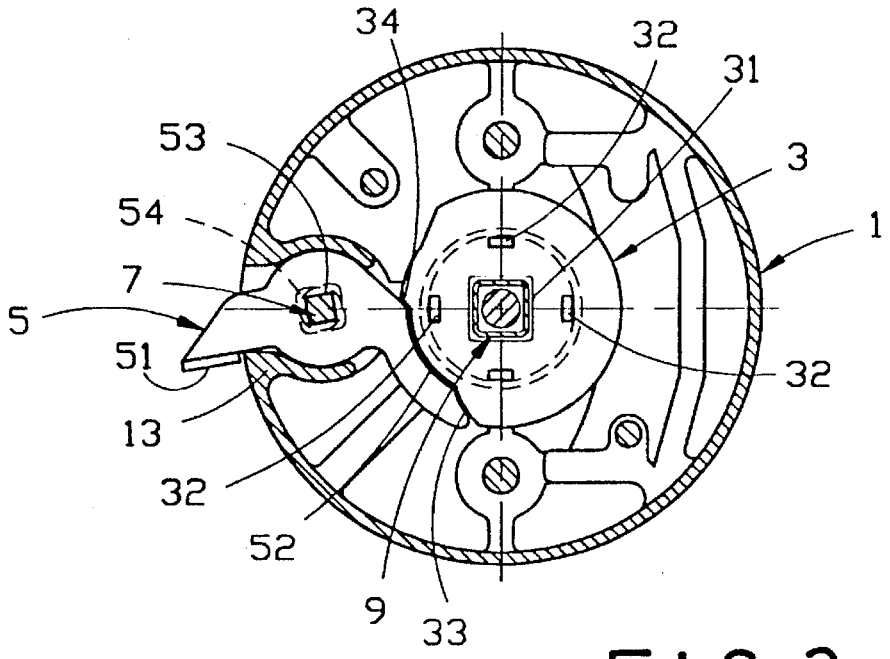
FIG. 3 is a sectional view taken along line III—III in FIG. 2, illustrating a release unit of the preferred embodiment.
Figure 4:
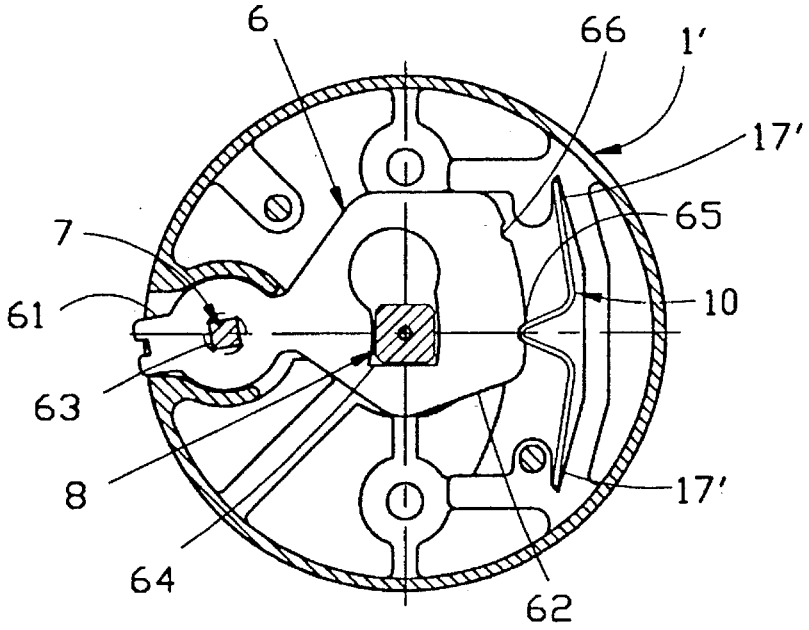
FIG. 4 is a sectional view taken along line IV—IV in FIG. 2, illustrating a locking member of the preferred embodiment when in a locking position.
Figure 5:
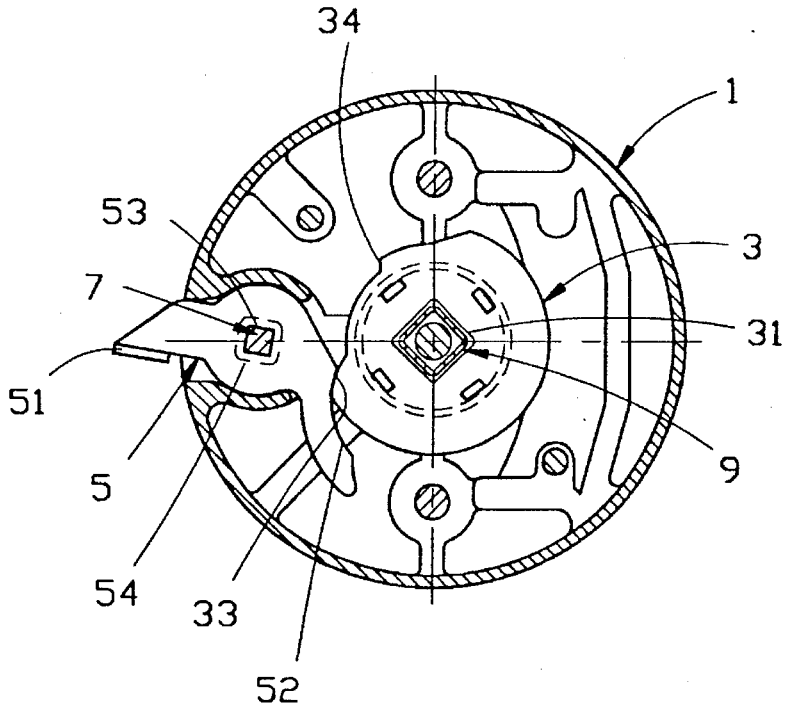
FIG. 5 illustrates the release unit when an inner door handle is turned in a first direction.
Figure 6:
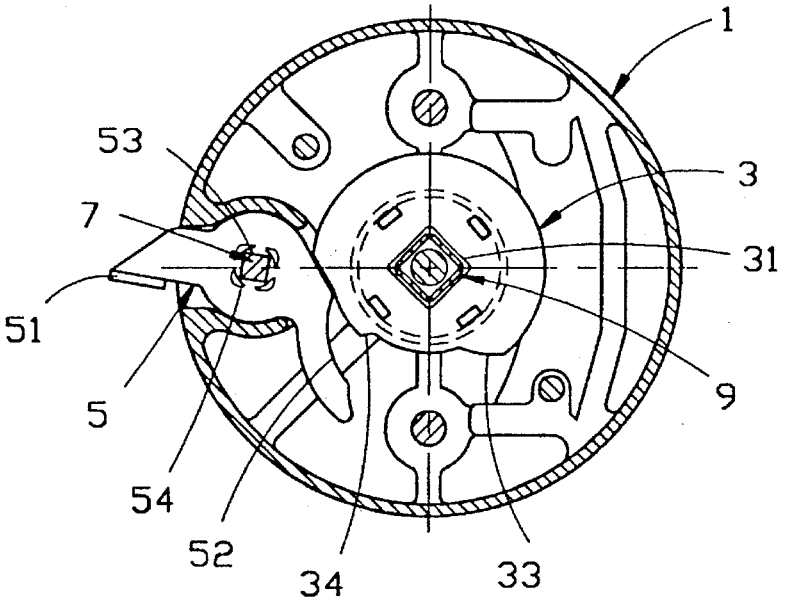
FIG. 6 illustrates the release unit when the inner door handle is turned in a second direction.
Figure 7:
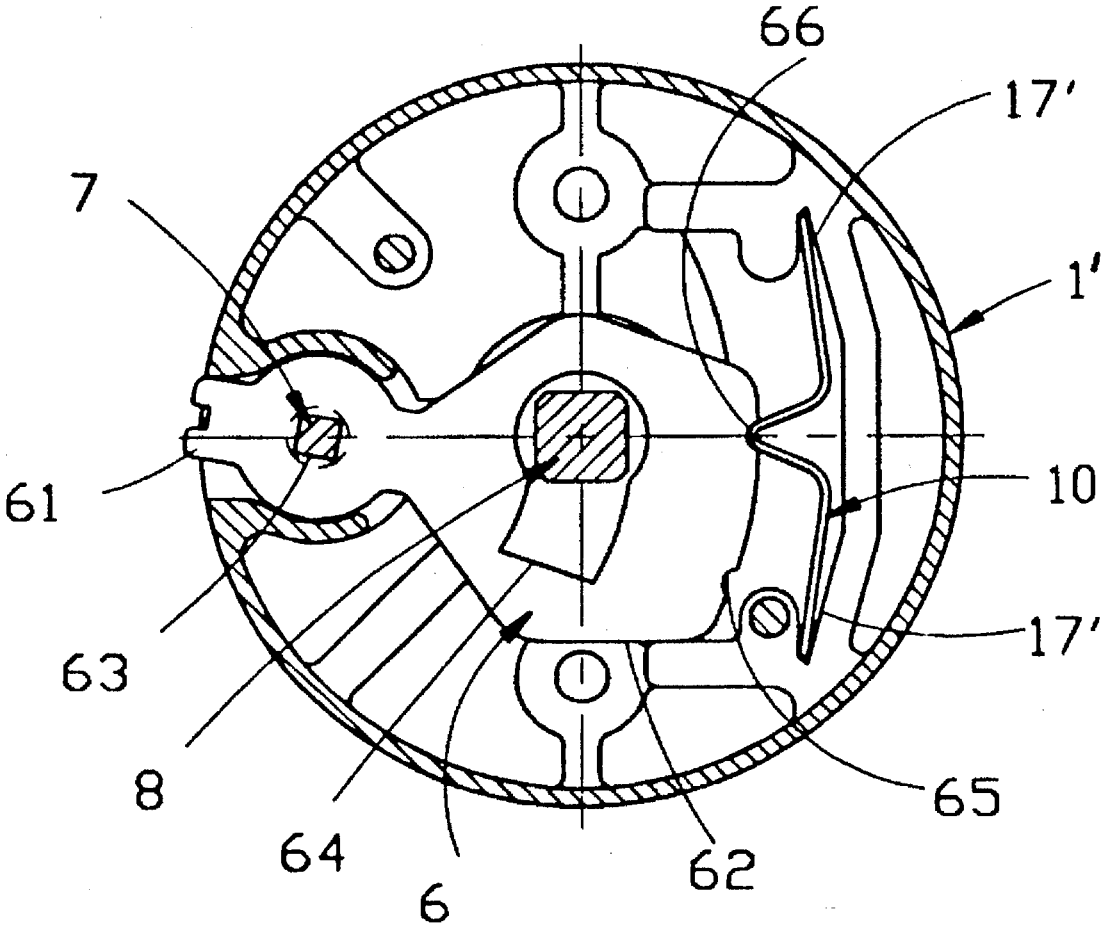
FIG. 7 illustrates the locking member when in a freeing position.

The operation of the preferred embodiment is as follows: When the release unit 5 is at the position shown in FIG. 3, the shaft engaging portion of the through-hole 64 of the locking member 6 engages the second latch shaft 8 to lock the second latch shaft 8 against rotation, as shown in FIG. 4. At this time, the outer door handle 2' cannot be rotated to open the door. When the inner door handle 2 is rotated in a first direction, as shown in FIG. 5, or in a second direction, as shown in FIG. 6, the first latch shaft 9 rotates to drive the cam drive 302 and retract the bolt member 301 (see FIG. 2). The door can be opened at this time. At the same time, the cam plate 3 rotates with the first latch shaft 9, thereby causing one of the cam portions 33, 34 of the cam plate 3 to drive the camming portion 52 of the release unit 5 and cause corresponding rotation of the link rod 7 and the locking member 6 to move the locking member 6 from the locking position (see FIG. 4) to the freeing position, as shown in FIG. 7. At this time, the second latch shaft 8 extends through and is unrestricted to rotate in an axial direction by the shaft releasing portion of the through-hole 64 of the locking member 6.

It has thus been shown that the door lock assembly of the present invention can be locked and unlocked from the inner side of a door by simply moving the lever portion 51 of the release unit 5 along the slot 13 of the housing 1. In case of an emergency, the door lock assembly can be unlocked from an outer side of the door by moving the first end portion 61 of the locking member 6 along the slot 13' of the housing 1' with the use of a tool. In addition, the door lock assembly is unlocked automatically when the lock assembly is operated from the inner side of the door due to the provision of the cam plate 3. The objectives of this invention are thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A lock assembly for a door, comprising:

an inner door handle to be mounted rotatably on an inner side of the door;

an outer door handle to be mounted rotatably on an outer side of the door;

a latch shaft unit including coaxial first and second latch shafts, each of which having a first end connected operably to a respective one of said inner and outer door handles and a second end coupled rotatably to other one of said first and second latch shafts;

a locking member to be mounted on the outer side of the door for movement between a locking position in which said locking member locks said second latch shaft against axial rotation and a freeing position in which axial rotation of said second latch shaft is permitted; and a release unit to be mounted on the inner side of the door, said release unit being associated operably with said locking member and being operable manually from the inner side of the door to move said locking member between said locking and freeing positions.

2. The locking assembly as claimed in claim 1, further comprising a cam plate mounted co-rotatably on said first latch shaft and actuating said release unit to move said locking member from said locking position to said freeing position when said first latch shaft is rotated by said inner door handle.

3. The lock assembly as claimed in claim 1, further comprising a hollow outer mounting body to be mounted on the outer side of the door, said outer mounting body being formed with a shaft hole to permit passage of said second latch shaft therethrough and having a peripheral wall formed with a circumferential slot, said locking member being a plate-like member disposed in said outer mounting body and having a first end portion projecting slightly out of said outer mounting body through said slot, an intermediate portion mounted pivotally and eccentrically to said outer mounting body, and a second end portion formed with a through-hole through which said second latch shaft extends and that has a shaft engaging portion conforming to cross-section of said second latch shaft and a shaft releasing portion larger than said shaft engaging portion, said first end portion of said locking member being operable from the outer side of the door to move along said slot in order to move said locking member between said locking position, in which said shaft engaging portion of said through-hole engages said second latch shaft to lock said second latch shaft against axial rotation, and said freeing position, in which said second latch shaft extends through and is unrestricted by said shaft releasing portion of said through-hole.

4. The lock assembly as claimed in claim 3, further comprising:

a hollow inner mounting body to be mounted on the inner side of the door, said inner mounting body being formed with a shaft hole to permit passage of said first latch shaft therethrough and having a peripheral wall formed with a circumferential slot, said release unit being disposed in said inner mounting body and having a lever portion projecting out of said inner mounting body through said slot and a pivot portion mounted pivotally and eccentrically to said inner mounting body; and a link rod having opposite ends extending rotatably and respectively into said outer and inner mounting bodies, said locking member and said release unit being mounted co-rotatably on said opposite ends of said link rod;

whereby, operation of said lever portion along said slot in said inner mounting body causes rotation of said link rod and corresponding rotation of said locking member to move said locking member between said locking and freeing positions.

5. The lock assembly as claimed in claim 4, wherein said release unit has a camming portion extending from said pivot portion, said lock assembly further comprising a cam plate disposed in said inner mounting body and mounted co-rotatably on said first latch shaft, said cam plate driving said camming portion and causing said release unit to rotate and cause corresponding rotation of said link rod and said locking member to move said locking member from said locking position to said freeing position when said first latch shaft is rotated by said inner door handle.

6. The lock assembly as claimed in claim 3, wherein said second end portion of said locking member is formed with first and second positioning notches, said lock assembly further comprising a spring member retained in said outer mounting body adjacent said locking member, said spring member engaging releasably said first positioning notch when said locking member is in said locking position and said second positioning notch when said locking member is in said freeing position.

* * * * *